US008468867B2

(12) United States Patent
Imperato

(10) Patent No.: US 8,468,867 B2
(45) Date of Patent: Jun. 25, 2013

(54) THREADROLLING MACHINE WITH DEVICE FOR UNLOADING WORKPIECES

(75) Inventor: Angelo Imperato, Novi Ligure (IT)

(73) Assignee: Ingramatic S.p.A., Castelnuovo Serivia (IT)

( * ) Notice: Subject to any disclaimer, the term of this patent is extended or adjusted under 35 U.S.C. 154(b) by 470 days.

(21) Appl. No.: 12/486,884

(22) Filed: Jun. 18, 2009

(65) Prior Publication Data

US 2010/0223972 A1 Sep. 9, 2010

(30) Foreign Application Priority Data

Jun. 19, 2008 (IT) ..... MI08A1114

(51) Int. Cl.
*B21D 45/02* (2006.01)
*B21H 9/00* (2006.01)
*B21H 9/02* (2006.01)

(52) U.S. Cl.
USPC ..... 72/427; 72/426; 470/164

(58) Field of Classification Search
USPC ..... 72/88–93, 419, 425–427; 470/164, 470/176, 177, 180, 902; 198/369.7, 735.4; 209/682
See application file for complete search history.

(56) References Cited

U.S. PATENT DOCUMENTS

| | | | | |
|---|---|---|---|---|
| 3,758,900 | A * | 9/1973 | Morton | 470/180 |
| 4,470,194 | A * | 9/1984 | Cambiaghi et al. | 29/783 |
| 4,938,336 | A * | 7/1990 | Aquino et al. | 198/369.2 |
| 5,560,238 | A * | 10/1996 | Allebach et al. | 72/13.4 |
| 2007/0222273 | A1 * | 9/2007 | Wood | 298/18 |

* cited by examiner

*Primary Examiner* — Dana Ross
*Assistant Examiner* — Pradeep C Battula
(74) *Attorney, Agent, or Firm* — Kirschstein et al.

(57) ABSTRACT

A rolling machine comprises parallel guides delimiting a workpiece conveying channel extending from a plurality of per se known rolling tools to a machined workpiece unloading arrangement, wherein, upstream of the workpiece unloading arrangement, one of the channel delimiting guides is operatively coupled to a structural element swingably supported by a pivot pin, the structural element being integral with the piston rod of a cylinder-piston unit slidably driving the structural element together with the channel delimiting guide, thereby providing a side unloading opening for the workpiece.

5 Claims, 6 Drawing Sheets

THREADROLLING MACHINE WITH DEVICE FOR UNLOADING WORKPIECES

BACKGROUND OF THE INVENTION

The present invention relates to a rolling machine including a machined-workpiece unloading device.

Rolling machines are well known in the prior art and are conventionally used for making, by permanent setting operations, cylindric workpieces, threads, slotted splines, grooves and collars.

Said prior rolling machines usually comprises a plurality of deforming tools, including a pair of parallelepipedal elements also called "deforming combs", one of which is mounted at a fixed position in the machine, whereas the other comb is movable and mounted on a slide driven by a connecting rod—crank mechanism.

In the above prior rolling machines, such as, for example, those made by the Applicant, the workpiece to be rolled is fed between the deforming combs by a feeding device to be deformed by said deforming combs at a deforming comb contact region. Said combs, in particular, have a shape depending on that to be formed on the finished cylindrical workpiece.

At the end of the working operations performed in prior rolling machines, the machined workpieces are unloaded under a certain kinetic energy and, accordingly, they impact against one another and the walls of the workpiece unloading chute, thereby they are damaged by dents on their rolled surface including, for example, a thread or a groove.

The above dents, which are nearly invisible to a naked eye, however, are not industrially acceptable since they can cause technical problems, for example as on said dented workpieces are clamped screws with a controlled screw clamping torque, for assembling a car engine.

Moreover, from said prior rolling machines, both perfectly machined and defective workpieces are unloaded and conveyed to workpiece containers and the defective workpieces must be necessarily separated.

SUMMARY OF THE INVENTION

Accordingly, the main object of the invention is to overcome the above mentioned drawbacks of the prior art by providing a workpiece unloading device, in combination with a rolling machine, adapted to prevent the unloaded machined workpieces from being damaged while allowing defective workpieces to be easily and quickly separated from non defective workpieces.

The above objects are achieved by a rolling machine including parallel guides delimiting a workpiece conveying channel extending from a per se known rolling tools, to a workpiece unloading arrangement, wherein, upstream of said workpiece unloading arrangement, one of said channel delimiting guides is integral with a structural element swingably supported by a pivot pin, and wherein said structural element is integral a piston rod of a cylinder-piston unit swingably driving said structural element together with a said channel delimiting guide, to provide a side unloading opening for said workpieces.

BRIEF DESCRIPTION OF THE DRAWINGS

Further advantages and characteristics of the rolling machine will become more apparent hereinafter from the following disclosure, the dependent claims and the accompanying drawings, where:

DESCRIPTION OF THE PREFERRED EMBODIMENT

Figure 1:
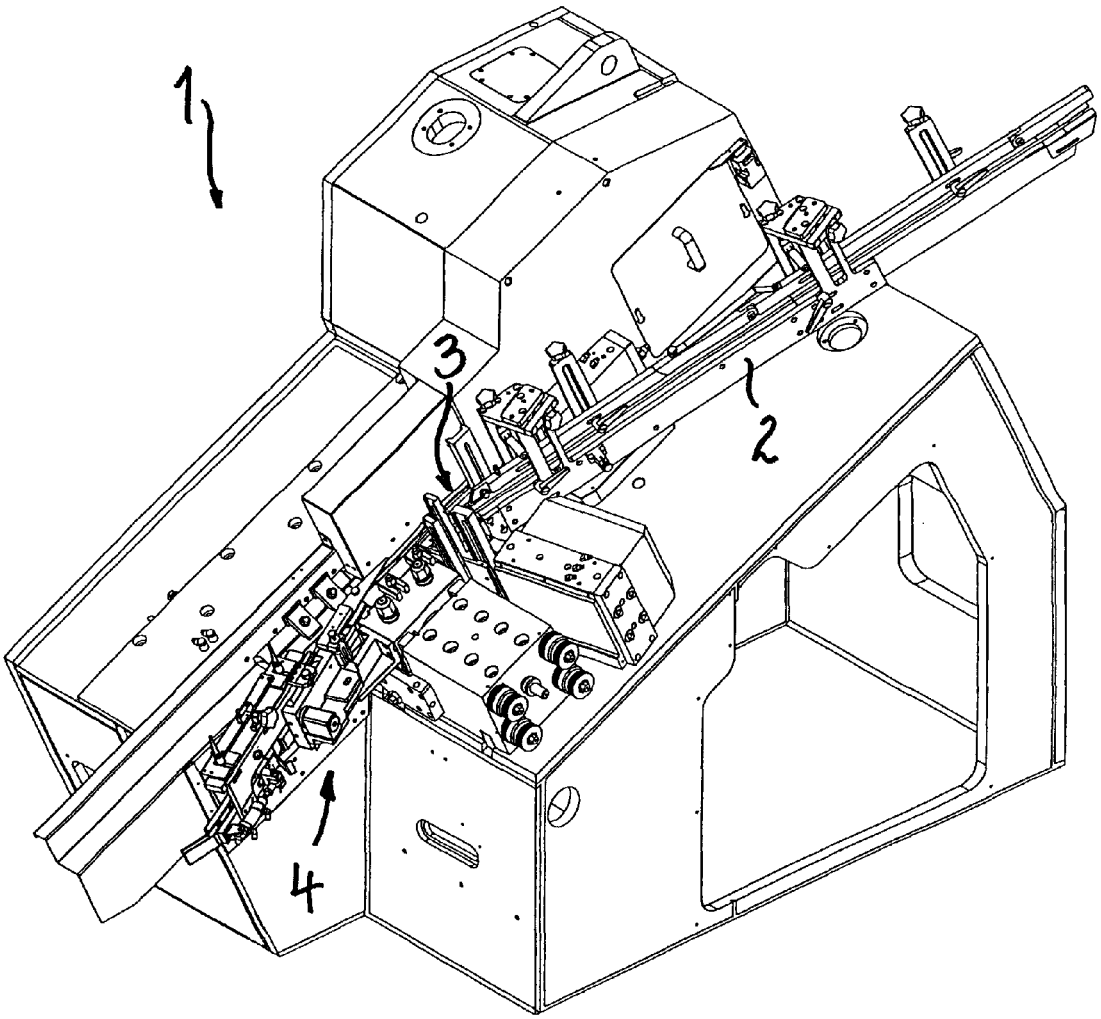
FIG. 1 is a perspective view showing a rolling machine including a workpiece unloading device according to the present invention.

As is shown in FIG. 1, the prior rolling machine 1 comprises a workpiece feeding guide 2 for feeding workpieces to be machined to a machining station, generally indicated by 3, in which station each workpiece is rotatively driven about its longitudinal axis and is further rectilinearly driven in parallel to the slide motion, said workpiece being then machined by deforming combs providing, by a permanent set of the workpiece, threads, toothed profiles, slots, grooves or collars on the circumferential surface of the cylindrical workpiece.

The above device is well known in the prior art.

According to the present invention, downstream of the deforming comb region 3, a workpiece unloading device, generally indicated by 4 is provided, which, in FIG. 1, is arranged in its working position.

Figure 2:
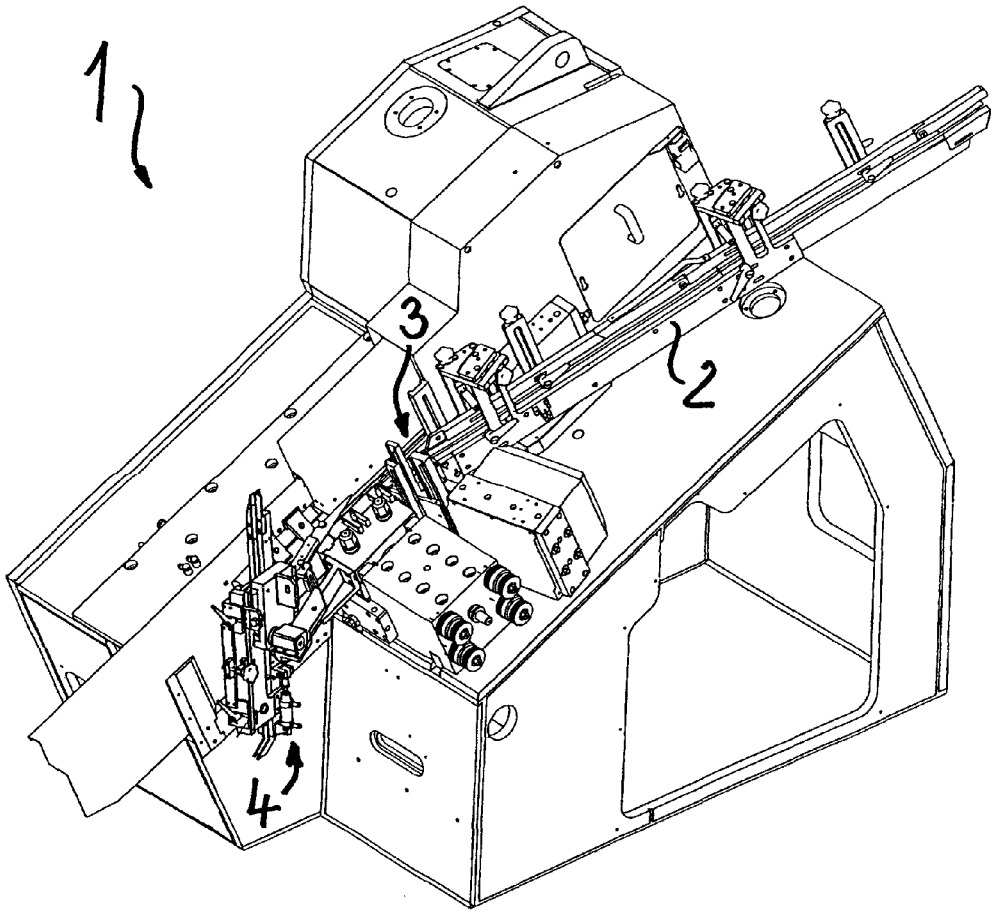
FIG. 2 shows the rolling machine with the workpiece unloading device in an idle position thereof.

In FIG. 2, the workpiece unloading device 4 is shown in a turned over position and is approximately arranged in a vertical plane, to perform on elements of said device 4 optional adjusting operations.

Figure 3:
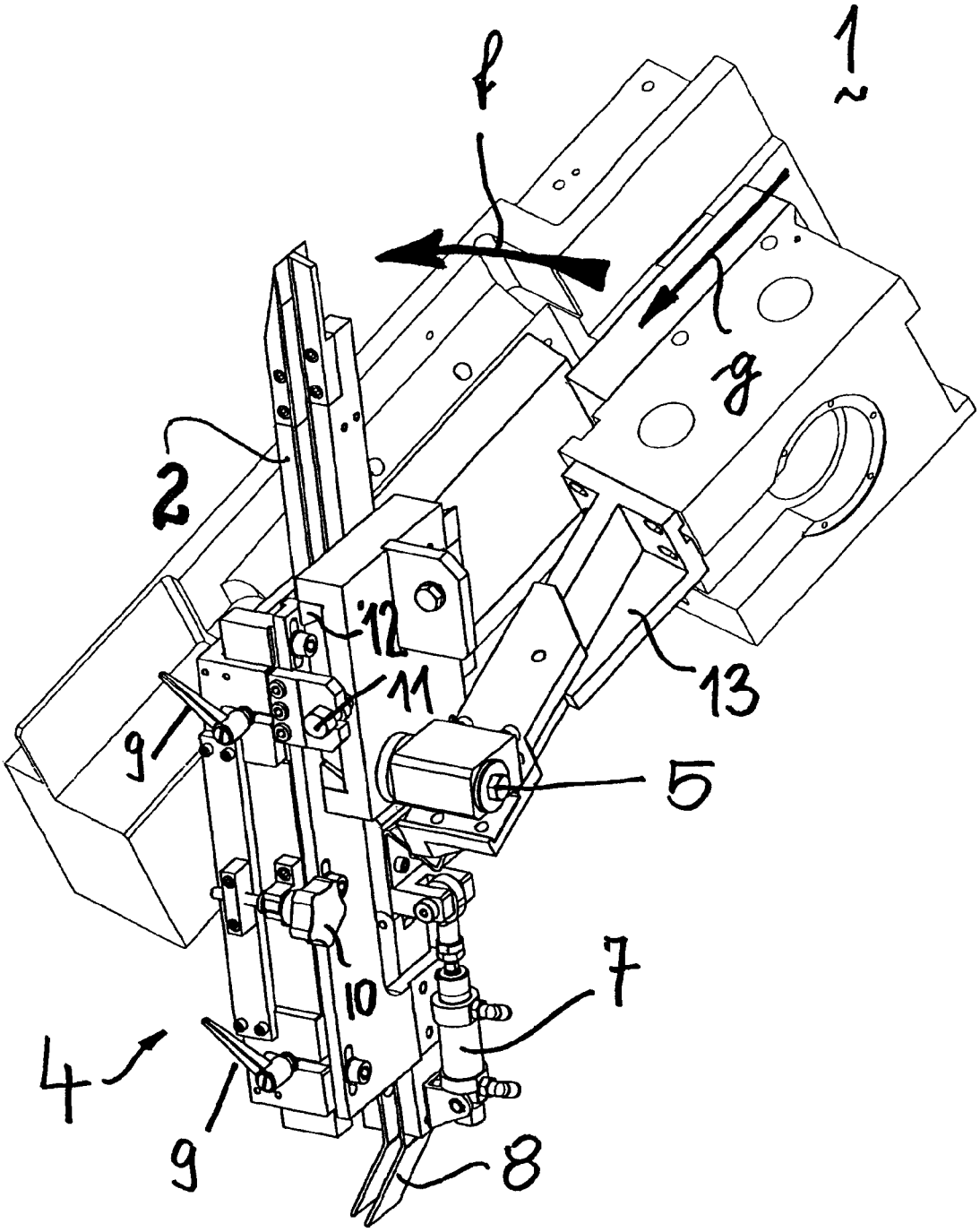
FIG. 3 shows a detail of the workpiece unloading device in its idle or inactive position allowing to perform adjusting operations thereon.

The machined workpiece unloading device 4, as is better shown in FIG. 3, may be turned over about a pivot pin 5, in the direction indicated by the arrow (f).

In such a condition, it is possible to perform adjusting and setting operations, in particular by adjusting the parallel guides 2 to which the workpieces are fed in the direction of the arrow (g).

The machined workpiece unloading device 4 comprises a cylinder-piston unit 7, which will be disclosed in a more detailed manner hereinafter.

At the end of the parallel guides 2 unloading guides 8 for delicately storing the machined workpieces, for example in a storing container, not herein shown, are provided.

Thus, by opening the locking levers 9 and operating the knob 10, it is possible to perform a width adjustment, whereas, by operating the screw 11, through prismatic guides 12, it is possible to perform a height adjustment operation.

The workpiece unloading device, together with the fixed comb holder block, is clamped by a strong supporting clamp element 13 to the construction of the machine 1 by a plurality of clamping screws.

Figure 4:
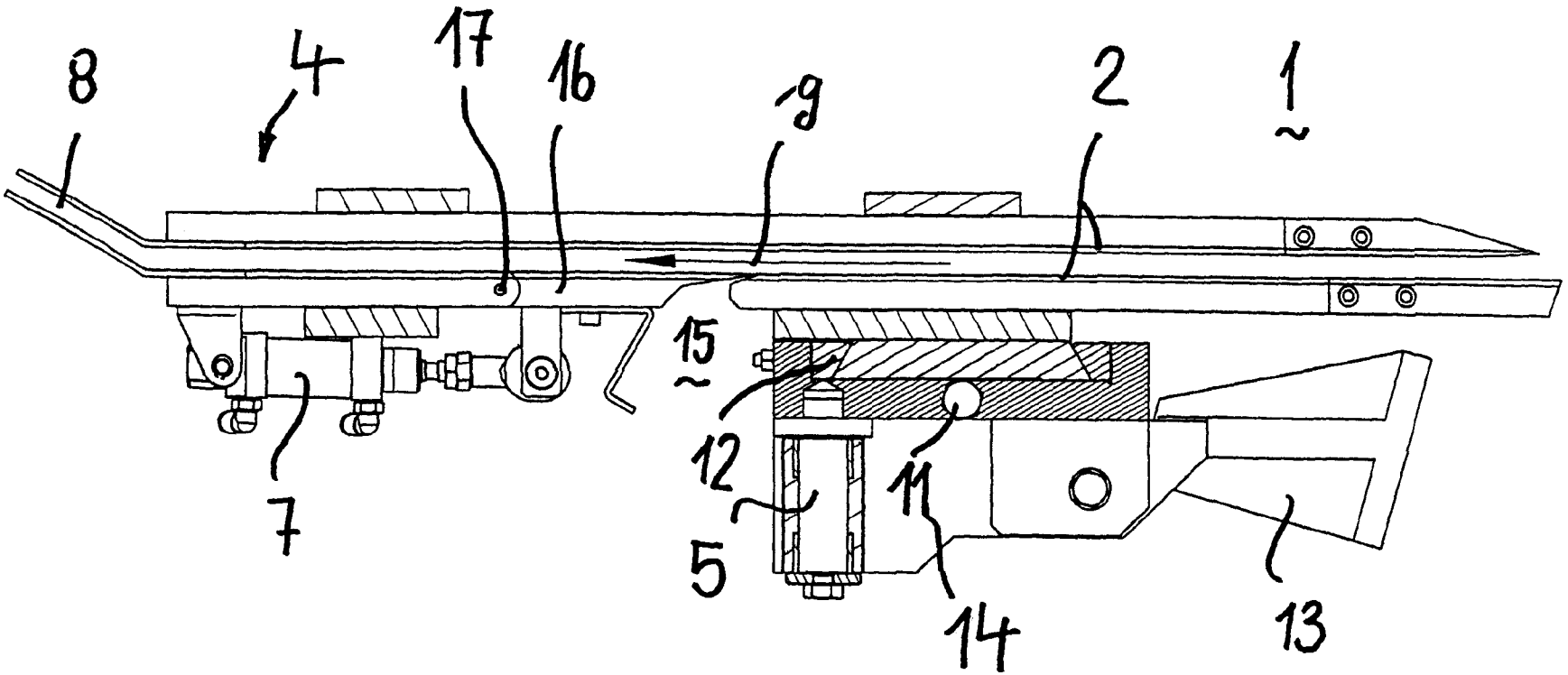
FIG. 4 is a top plan view of the workpiece unloading device.

FIG. 4 shows a top plan view of the workpiece unloading device 4. It is possible to note in this figure that the supporting element 13, integral with the construction or casing of the machine 1, comprises an extension 14 supporting the device 4 swinging pivot pin 5.

The extension 14 further supports a prismatic guide 12 thereby, by controllably operating the adjusting screw 11, it is possible to controllably drive the device 4 in a plane perpendicular to the FIG. 4 sheet, to fit the device to the length of the rolled workpiece.

As shown in FIG. 4, the workpiece, conveyed along the parallel guides 2, slides on said guides 2 in the direction indicated by the arrow (g) to the unloading arrangement 8.

Moreover, FIG. 4 also shows that, downstream of the supporting element 14, along the parallel guides 2, a controllable unloading opening 15 is further provided which is closed by a structural element 16 of said guides 2 and being swingably supported by a pivot pin 17, the swinging movement, driven by said structural element 16 being started by said cylinder-piston unit 7.

Figure 5:
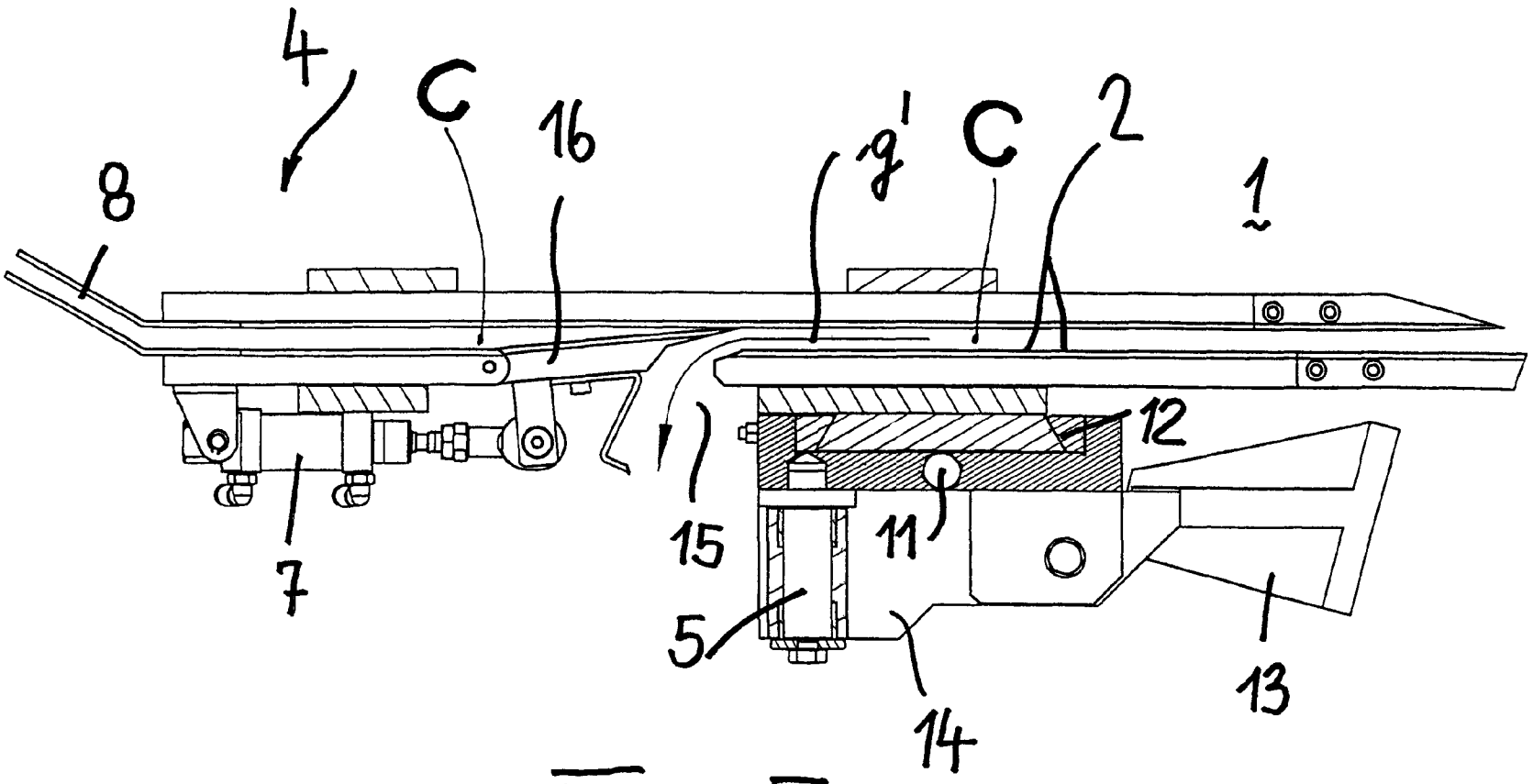
FIG. 5 shows the workpiece unloading device in a condition thereof for unloading defective workpieces.
Figure 6:
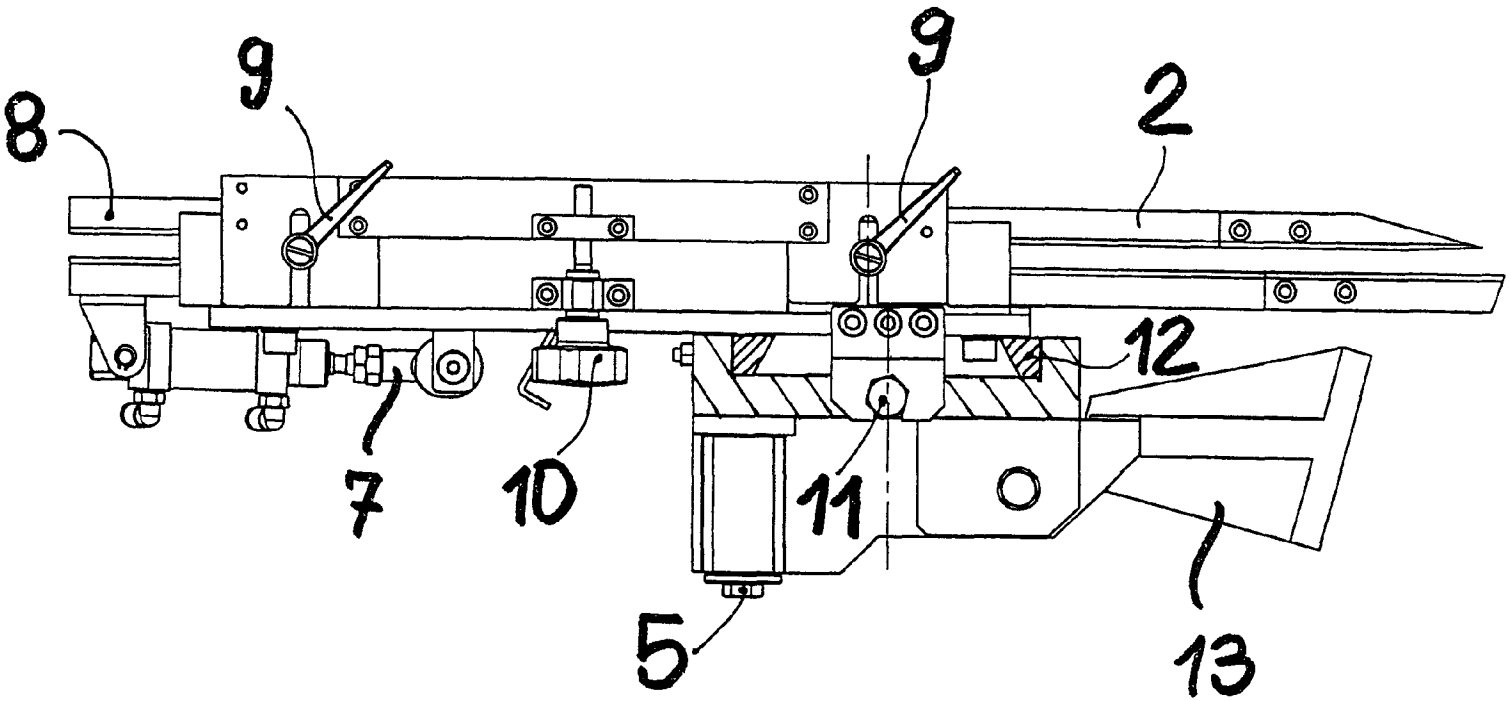
FIG. 6 is a further top plan view of the workpiece unloading device.

Thus, as the structural element 16 is swingably driven (FIG. 5), the channel C, directed toward the unloading guides 8 and defined between the parallel guides 8 is closed, thereby providing a switching zone 15, for allowing defective pieces to be unloaded, as shown by the arrow (g').

The switching or separating device 16 is controllably driven by the cylinder-piston unit 7 in turn controlled by an optical control device or any other suitable control device, arranged at said guides 2, for detecting possible fault conditions and/or variations in the force diagram of the rolling mechanisms.

Advantageously, the parallel guides 2, respectively the channel C, are arranged in a plane inclined from a horizontal line.

The invention claimed is:

1. A rolling machine, comprising:

a machining station for machining workpieces;

a pair of parallel, elongated, feed guides extending to the machining station and bounding a feed channel along which the workpieces are conveyed to the machining station;

a pivotable unloading station mounted on the rolling machine downstream of the machining station for pivoting movement between a working position and an adjusting position, the unloading station having a pair of parallel, elongated, unloading guides bounding an unloading channel along which the machined workpieces are conveyed away from the machining station;

a drive on the unloading station, and operative in the working position, for moving a movable member between a blocking position in which the movable member blocks the unloading channel and diverts defective ones of the machined workpieces away from the unloading station along one path for collection of the defective workpieces, and an unblocking position in which the movable member unblocks the unloading channel and permits passage of non-defective ones of the machined workpieces away from the unloading station along another path for collection of the non-defective workpieces;

a first manual control on the unloading station, and operative in the adjusting position, for moving the unloading guides towards and away from each other in a direction transverse to the elongation of the unloading guides to adjust a width distance between the unloading guides; and a second manual control on the unloading station, and operative in the adjusting position, for moving the unloading guides in elevation relative to the feed guides.

2. The rolling machine according to claim 1, wherein the movable member is pivotably mounted at the unloading station, and wherein the drive is a piston and cylinder unit operable for pivoting the movable member between the blocking and the unblocking positions.

3. The rolling machine according to claim 1, wherein the unloading station has a side opening through which the defective workpieces are diverted in the blocking position.

4. The rolling machine according to claim 1, and a manual lock on the unloading station for locking the unloading station in the working position.

5. The rolling machine according to claim 1, wherein the unloading station extends along a vertical plane in the adjusting position.

* * * * *